US006386735B1

(12) United States Patent
Lin

(10) Patent No.: US 6,386,735 B1
(45) Date of Patent: May 14, 2002

(54) DECORATIVE TUNNEL LIGHT SHOWING DISTANTLY CONVERGING LIGHTS

(76) Inventor: Rich Lin, 17F, No. 309, Sec.2, Wen Hua Rd, Panchiao, Taipei Hsien (TW)

( * ) Notice: Subject to any disclaimer, the term of this patent is extended or adjusted under 35 U.S.C. 154(b) by 0 days.

(21) Appl. No.: 09/660,832

(22) Filed: Sep. 13, 2000

(51) Int. Cl.[7] ..... F21V 21/00

(52) U.S. Cl. ..... 362/249; 362/240; 362/806; 362/811; 362/232

(58) Field of Search ..... 362/249, 806, 362/811, 240, 232, 140

(56) References Cited

U.S. PATENT DOCUMENTS 5,951,143 A * 9/1999 Ginsberg ..... 362/140

* cited by examiner

*Primary Examiner*—Stephen Husar
*Assistant Examiner*—Ali Alavi
(74) *Attorney, Agent, or Firm*—David E. Dougherty

(57) ABSTRACT

A decorative tunnel light includes a casing having at least a front window, a front plane reflective mirror closely located behind the front window, a rear convex reflective mirror behind the front mirror with a predetermined distance existing between them, and a light string consisting of a plurality of bulbs located between the front and the rear reflective mirrors with the bulbs equally spaced along and radially inward projected from a periphery of the window. When the bulbs of the light string are lightened, lights from the bulbs repeatedly reflect off the front plane and the rear convex reflective mirrors to show behind the front window a plurality of lines of images of lights that converge in the distance in the tunnel light. The convex reflective mirror may be of any curvature and eccentric from the front window.

1 Claim, 5 Drawing Sheets

DECORATIVE TUNNEL LIGHT SHOWING DISTANTLY CONVERGING LIGHTS

BACKGROUND OF THE INVENTION

The present invention relates to a decorative tunnel light, and more particularly to a decorative tunnel light that shows distantly converging lights.

A tunnel light includes front and rear reflective mirrors and a light string all mounted in a casing. When the light string is turned on, lights emitted from bulbs connected to the light string repeatedly reflect off the front and the rear reflective mirrors to show plural lines of images of lights that can be externally viewed from a front window on the casing. In a conventional tunnel light, both the front and the rear reflective mirrors are plane mirrors, and the created plural lines of images of lights are short and do not converge at a distant point in the tunnel light. That is, the tunnel light does not create a deep and distant visual effect.

SUMMARY OF THE INVENTION

A primary object of the present invention is to provide a decorative tunnel light that shows distantly converging lights to create a unique, deep and distant visual effect. To achieve the object, the tunnel light of the present invention mainly includes a casing having at least a front window, a front plain reflective mirror closely located behind the front window, a rear convex reflective mirror behind the front mirror with a predetermined distance existing between them, and a light string consisting of a plurality of bulbs located between the front and the rear reflective mirrors with the bulbs equally spaced a long and radially inward projected from a periphery of the window. When the bulbs of the light string are lightened, lights from the bulbs repeatedly reflect off the front plain and the rear convex reflective mirrors to show behind the front window a plurality of lines of images of lights that converge in the distance in the tunnel light. And, the rear convex reflective mirror may be of any curvature and eccentric from the front window.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
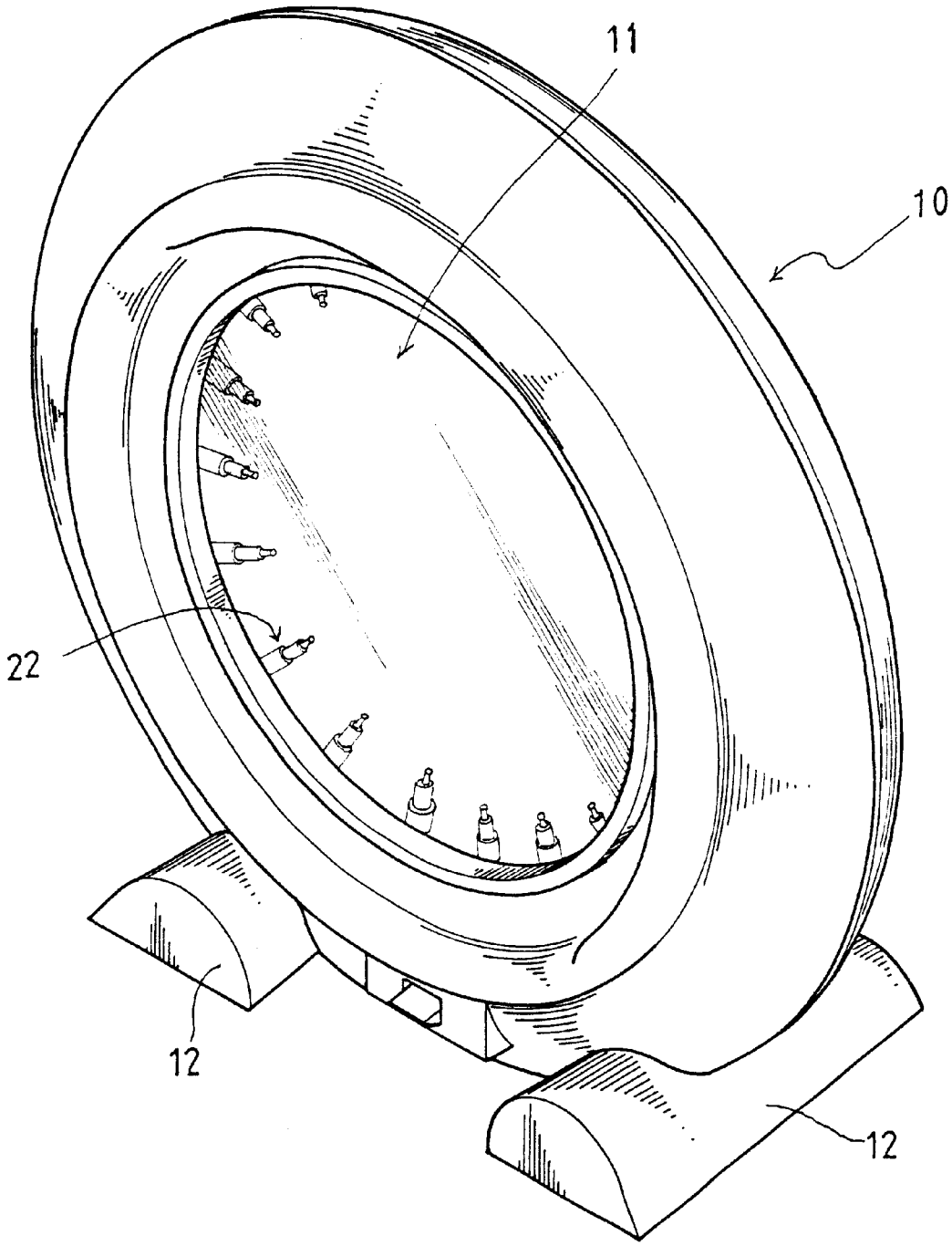
FIG. 1 is a perspective of a tunnel light according to an embodiment of the present invention.
Figure 2:
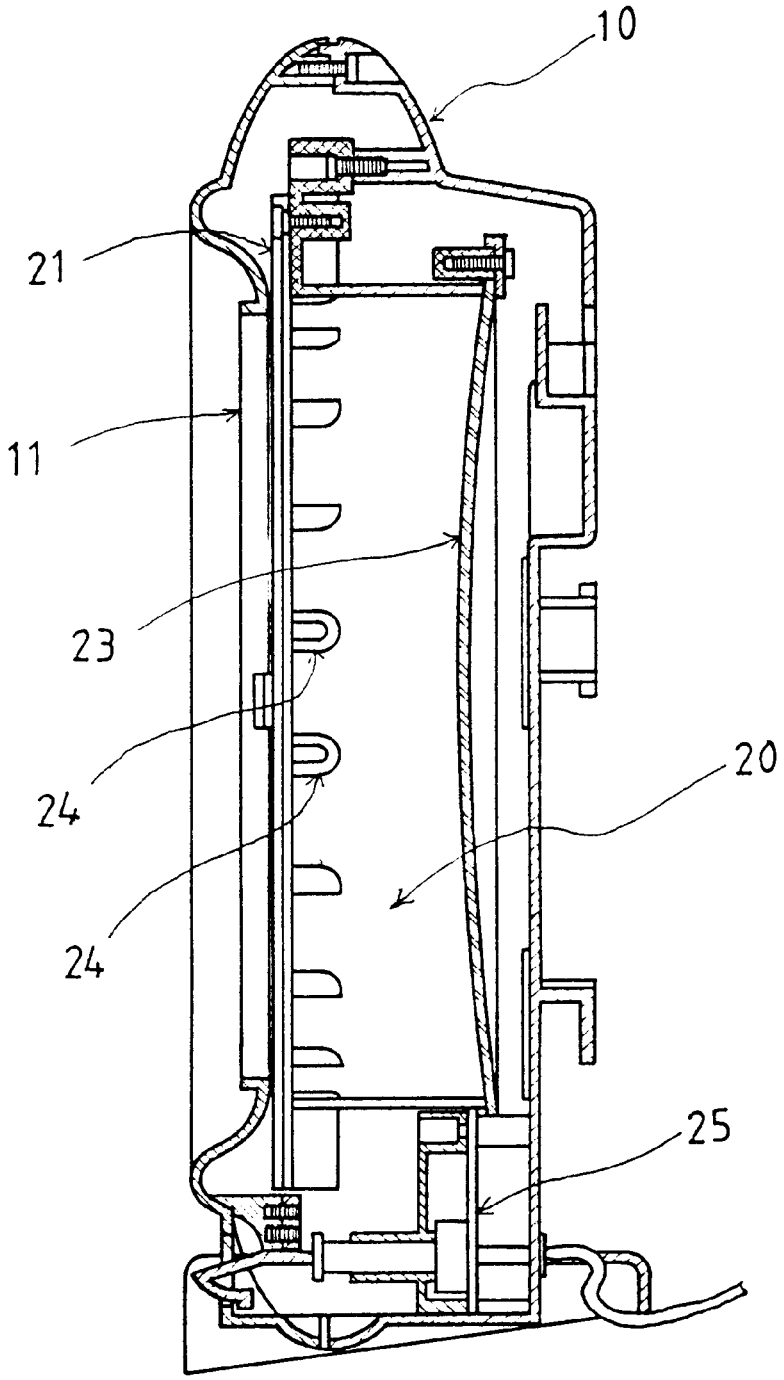
FIG. 2 is a sectioned side view of the tunnel light of FIG. 1.
Figure 3:
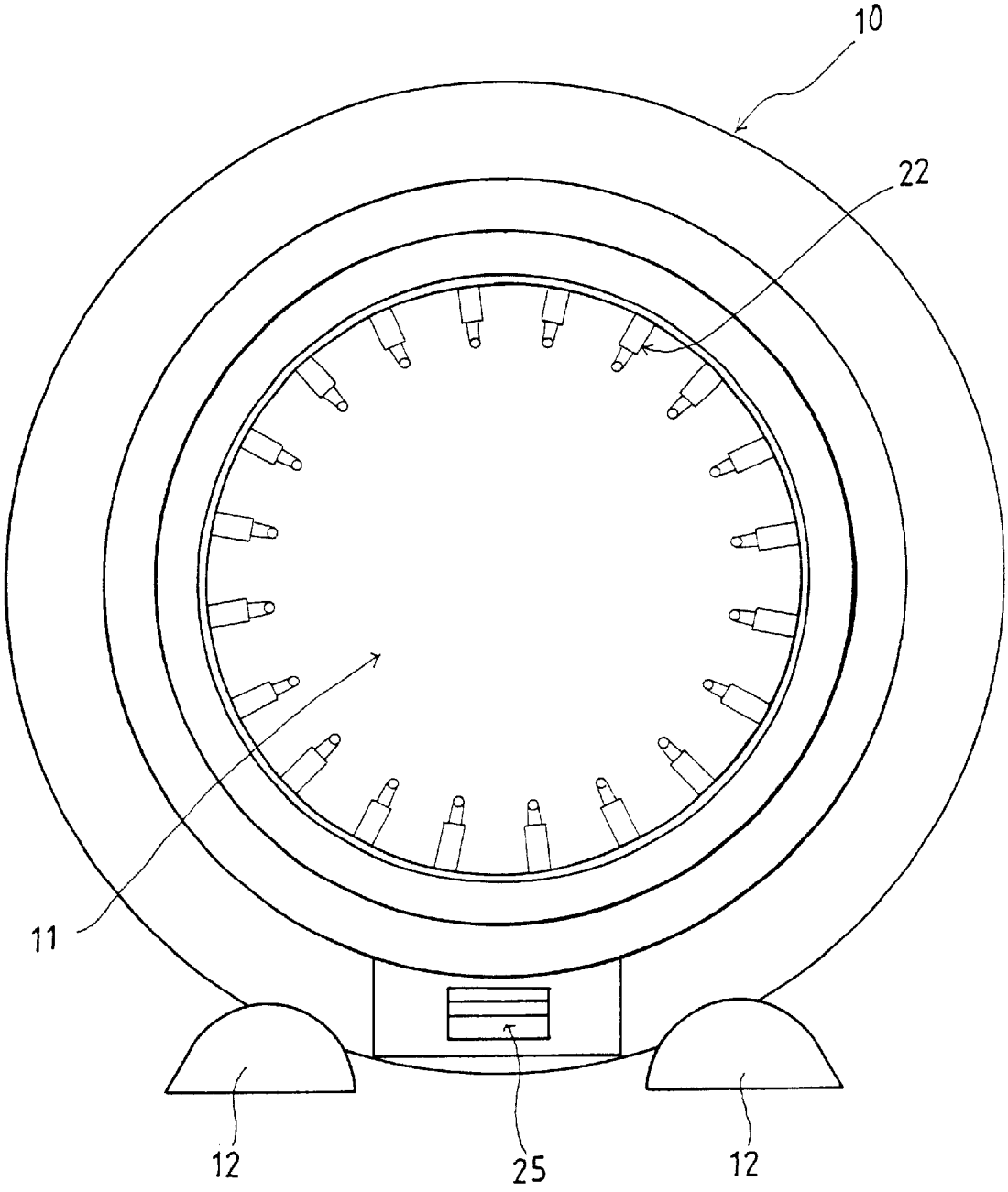
FIG. 3 is a front elevation of the tunnel light of FIG. 1.

Please refer to FIGS. 1, 2 and 3 in which a so-called tunnel light is shown. The tunnel light is generally positioned on a desktop or mounted on a wall as a decoration and mainly includes a casing 10 and a set of internal components 20. The casting 10 may be of any shape and is provided with at least a front window 11 that is preferably round in shape. The casting 10 may be provided with a base 12 in a suitable form for the tunnel light to stably stand on a top of a desk or table. Alternatively, the casing 10 may be provided at a back thereof with, for example, a hole for mounting tunnel light on a wall.

Please refer to FIG. 2, the internal on a wall includes a front reflective mirror 21, a light string 22 consisting of a plurality of serially connected bulbs, and a rear reflective mirror 23. The front reflective mirror 21 is located close to an inner side of the window 11 and is a special transparent plane mirror. When the inner side of the window 11 is darker than an outer side of the window 11, the front reflective mirror 21, when viewing from outer side of the window 11, looks just like a common plane reflective mirror. However, when the inner side of the window 11 is brighter than the outer side of the window 11, the front reflective mirror 21 can be fully seen through. The light string 22 is located behind the front reflective mirror 21. Bulbs may be easily connected to the light string 22 via sockets 24 and thereby equally spaced along and radially inward projected from a periphery of the window 11. The rear reflective mirror 23 is located behind the light string 22 with a predetermined distance existing between them.

When the light string 22 is turned on to lighten all the bulbs thereof, lights from the bulbs repeatedly reflect off the front and the rear reflective mirrors 21, 23 to show a plurality of lines of images of lights that look like converging in the distance, as a scene that can be usually seen in a tunnel. The light string 22 may be controlled through an electronic control means 25 that includes a circuit board and push-button switches, etc., so that the bulbs may be grouped into several groups to be lightened at different times or time intervals, creating more changed in the images of lights presented in the tunnel light.

Figure 4:
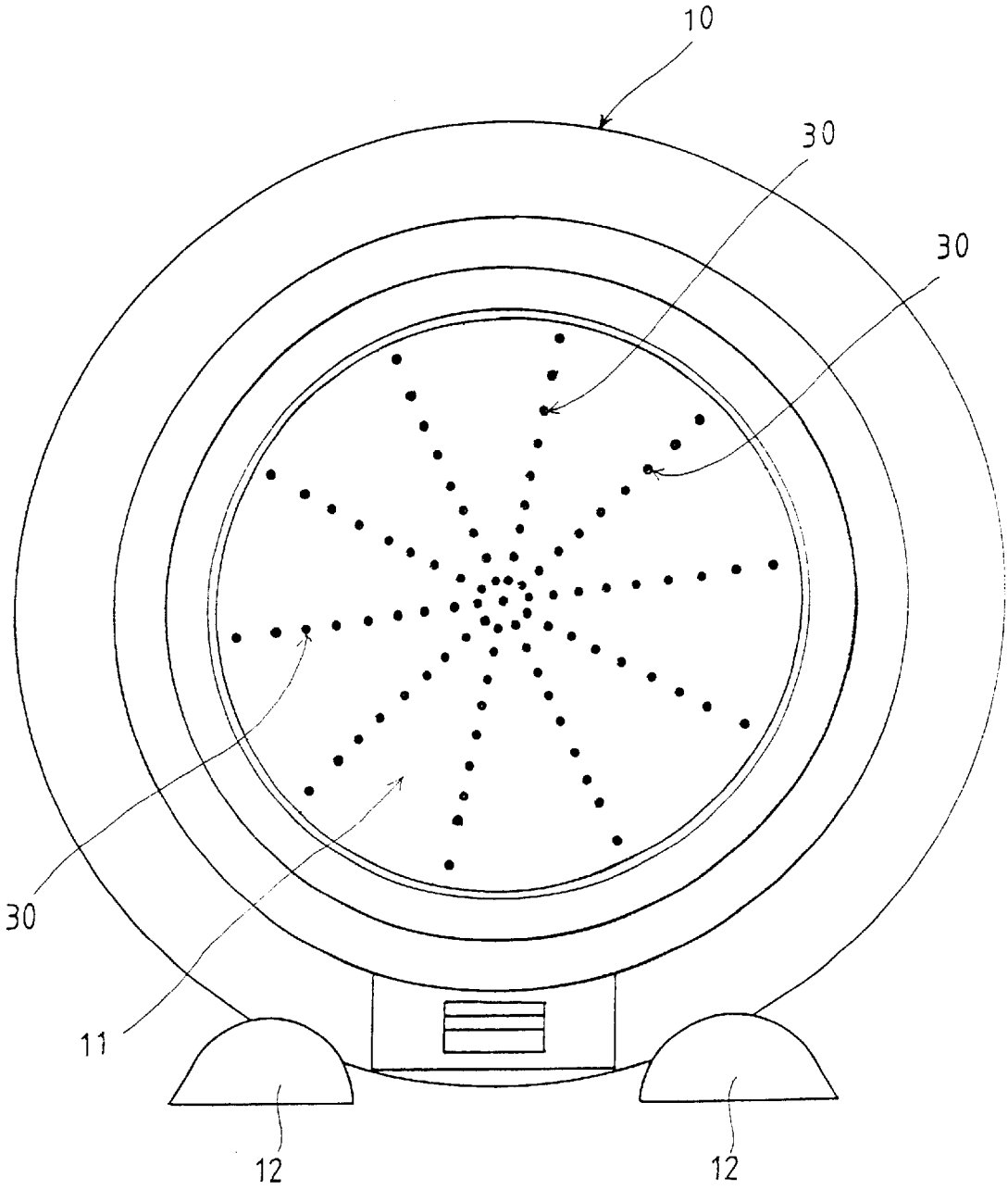
FIG. 4 is a front elevation of the tunnel light of FIG. 1 in which the repeatedly reflected lights converge in the distance.

In the conventional tunnel light, since both the front and the rear reflective mirrors are plane mirrors, the multiple lines of images of lights presented in the tunnel light do not converge at a furthest point and therefore create only a vision of lights at two sides of a short corridor instead of a long tunnel. In contrast with the conventional tunnel light, the present invention is characterized in that the rear reflective mirror 23 is a convex mirror. When viewing in front of the window 11, the plural lines of images of lights 30 together created by the light string 22 and the front plane mirror 21 and the rear convex mirror 23 converge at a distant point in the tunnel light, as shown in FIG. 4, making the scene in the tunnel light looked like a plurality of lights in a very long tunnel that is a visual effect completely different from that created by the conventional tunnel light.

The rear convex reflective mirror 23 may be differently designed to have different curvatures or focal lengths, depending on customer requirements. The number of images of lights included in each line of lights and the distance in which the lines of images of lights converge as presented in the tunnel light varies with the curvature or focal length of the convex reflective mirror 23.

Figure 5:
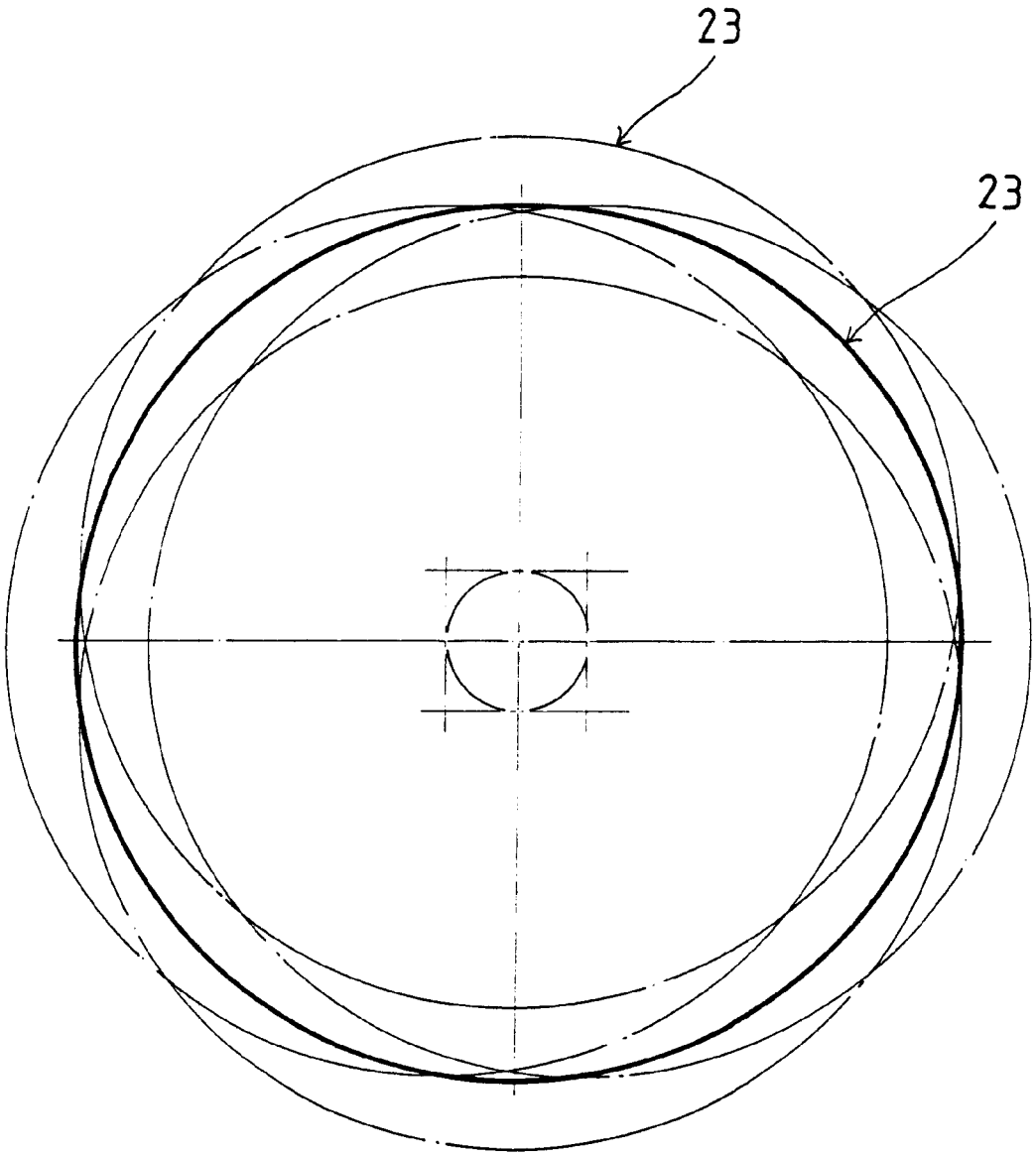
FIG. 5 is a front view showing the rear reflective mirror of the tunnel light of the present invention may be differently eccentric from the window of the tunnel light.

Moreover, it is not necessary for focus of the rear convex reflective mirror 23 to align with a central axis of the window 11. The rear convex mirror 23 may be vertically or laterally shifted relative to the window 11 to an eccentric position in the window 11, as shown in FIG. 5, so that various visual effects may be created in the tunnel light. In this case, a convergent point of the plural lines of lights in the tunnel light also offsets from a center of the window 11. It is also possible to adjust the eccentricity of the convex mirror 23 relative to the window 11 by means of additional driving means (not shown). The driving means may automatically and slowly drive the rear convex reflective mirror 23 to different eccentric positions, so that the plural lines of images of lights automatically eccentrically shift behind the window 11 to create continuous changes of views in the tunnel light.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A decorative tunnel light showing distantly converging lights comprising a casing and a set of internal component; said casing being of any shape and having at least a front window; said set of internal component including a front plane reflective mirror closely located behind said front window of said casing, a light string consisting of a plurality of bulbs, an electronic control means for controlling said light string, and a rear reflective mirror; said light string being located between said front and said rear reflective mirrors with said bulbs equally spaced along and radially inward projected from a periphery of said window, and said rear reflective mirror being a convex mirror, whereby when said bulbs of said light string are lit, lights from said bulbs repeatedly reflect off said front plane and said rear convex reflective mirrors to show behind said window a plurality of lines of images of lights that converge in the distance in said tunnel light and wherein said rear convex reflective mirror has a focus that is not necessarily aligned with a central axis of said front window, and said rear convex reflective mirror being vertically and laterally adjustable to an eccentric position relative to said front window.

* * * * *